US009411253B2

(12) United States Patent
Naruse et al.

(10) Patent No.: US 9,411,253 B2
(45) Date of Patent: Aug. 9, 2016

(54) IMAGE FORMING APPARATUS FORMING REGISTRATION PATCHES FOR DETECTION OF DISPLACEMENT OF TONER IMAGES

(71) Applicant: Konica Minolta, Inc., Tokyo (JP)

(72) Inventors: Kunihiko Naruse, Toyokawa (JP); Morihisa Kawahara, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/016,353

(22) Filed: Sep. 3, 2013

(65) Prior Publication Data

US 2014/0064799 A1 Mar. 6, 2014

(30) Foreign Application Priority Data

Sep. 3, 2012 (JP) ..... 2012-193462

(51) Int. Cl.
*G03G 15/00* (2006.01)
*G03G 15/01* (2006.01)

(52) U.S. Cl.
CPC ..... *G03G 15/0131* (2013.01); *G03G 15/0189* (2013.01); *G03G 15/5058* (2013.01); *G03G 2215/0158* (2013.01)

(58) Field of Classification Search
CPC ..... G03G 15/0131; G03G 15/0189
USPC ..... 399/301
See application file for complete search history.

(56) References Cited

FOREIGN PATENT DOCUMENTS

| | | |
|---|---|---|
| JP | 2007293047 A | 11/2007 |
| JP | 2008-96811 | 4/2008 |
| JP | 2009-47741 | 3/2009 |

OTHER PUBLICATIONS

Computer translation of JP2009-047741A to Tadashi et al., publ May 3, 2009.*
Office Action dated Aug. 10, 2015 issued from the corresponding Chinese Patent Application No. 201310389013.8.
English translation of Office Action dated Aug. 10, 2015 issued from the corresponding Chinese Patent Application No. 201310389013.8.
Notification of Reasons for Refusal dated Jun. 23, 2016; Patent Application No. 2013-141172; English translation of Notification of Reasons for Refusal; Total of 10 pages.

* cited by examiner

*Primary Examiner* — Quana M Grainger
(74) *Attorney, Agent, or Firm* — Lucas & Mercanti, LLP

(57) ABSTRACT

The rotation speed of an intermediary transfer belt 41 when it is brand-new is stored as a reference rotation speed. Registration patches Rk to Ry are formed to calculate displacement amounts, and based on the rotation speed difference between the rotation speed of the intermediary transfer belt 41 and the reference rotation speed, the calculated displacement amounts are corrected into displacement amounts expected when the secondary transfer roller 42 is contacted with the intermediary transfer belt 41. Next, based on the corrected displacement amounts, the positions at which exposing devices 60K to 60Y form electrostatic latent images are corrected. Thus, registration correction can be performed accurately without requiring too much time or toner, with consideration given to the difference in the rotation speed of the intermediary transfer belt 41 depending on whether the secondary transfer roller 42 is contacted with or released from the intermediary transfer belt 41.

20 Claims, 4 Drawing Sheets

ROLLER PRESS-CONTACTED

ROLLER RELEASED

IMAGE FORMING APPARATUS FORMING REGISTRATION PATCHES FOR DETECTION OF DISPLACEMENT OF TONER IMAGES

This application is based on Japanese Patent Application No. 2012-193462 filed Sep. 3, 2012, the content of which is hereby incorporated by reference.

BACKGROUND OF THE INVENTION

1. Field of the Invention

The present invention relates to an image forming apparatus, and more particularly to an image forming apparatus that forms registration patches of different colors on an intermediary transfer member and detects the thus formed registration patches of the different colors to correct for a color displacement in a color image based on the results of the detection.

2. Description of Related Art

For example, in a tandem-type color image forming apparatus, image forming units for different colors, each built around a photoconductive drum and a transferring device, are arranged along an intermediary transfer belt. In each image forming unit, the photoconductive drum is scanned with, and exposed to, a laser beam from a laser diode to form an electrostatic latent image, which is then developed with toner to form a toner image. Thereafter, those toner images are primarily transferred to the intermediary transfer belt in a superposed fashion. The toner images of the different colors thus primarily transferred are then, at a secondary transfer position, secondarily transferred, all at once, to a sheet of a printing medium that passes between the intermediary transfer belt and a secondary transfer roller which rotates in contact with it.

In such a color image forming apparatus, factors such as secular deterioration of the photoconductive drum, intermediary transfer belt, secondary transfer roller, etc. and variations in temperature and humidity around the apparatus can cause, among others, a displacement between the positions exposed to the laser beam for the different colors, resulting in a color displacement. To prevent that, color displacement correction is often performed. One example of color displacement correction is registration correction, whereby registration patches comprising toner images of different colors are formed on the intermediary transfer belt and, based on the positions at which the registration patches of the different colors are formed, the displacement amounts of the different colors are detected, and the image write positions are corrected.

During registration correction, if the secondary transfer roller is in contact with the intermediary transfer belt, the registration patches on the intermediary transfer belt attach to the secondary transfer roller and soil the roller surface. The soil on the roller surface then, during image formation, soils the reverse side of the sheet. To prevent that, conventionally, the secondary transfer roller is configured to be releasably contactable with the intermediary transfer belt and, during registration correction, the secondary transfer roller is so controlled as to be released from the intermediary transfer belt.

However, as the coefficient of friction between the intermediary transfer belt and a driving roller that makes it rotate decreases with use, a difference arises in the rotation speed of the intermediary transfer belt between when the secondary transfer roller is contacted with the intermediary transfer belt and when the secondary transfer roller is released from the intermediary transfer belt. Thus, actual image formation and registration correction are performed under different conditions, and this makes accurate correction of a color displacement impossible. One possible solution is to increase the belt tension of the intermediary transfer belt to make the speed of the intermediary transfer belt constant irrespective of whether the secondary transfer roller is contacted with or released from the intermediary transfer belt. Increasing the belt tension, however, can lead to, among others, a crack in the intermediary transfer belt.

Thus, for example, Patent Document 1 (Japanese Patent Application Publication No. 2009-47741) discloses a technology whereby registration patches are formed with the secondary transfer roller both contacted with and released from the intermediary transfer belt and the difference in the rotation speed of the intermediary transfer belt depending on whether the secondary transfer roller is contacted with or released from the intermediary transfer belt is calculated to correct displacement amounts.

However, with the technology disclosed in Patent Document 1 (Japanese Patent Application Publication No. 2009-47741), the registration patches need to be formed also with the secondary transfer roller contacted with the intermediary transfer belt, and registration correction requires more time and toner.

Against the background discussed above, an object of the present invention is to provide an image forming apparatus that can perform registration correction accurately without requiring too much time or toner, with consideration given to the difference in the rotation speed of an intermediary transfer member depending on whether a secondary transfer roller is contacted with or released from the intermediary transfer member.

SUMMARY OF THE INVENTION

To achieve the above object, according to one aspect of the present invention, an image forming apparatus includes: a plurality of image forming units configured to write electrostatic latent images on image carrying members by exposing portions and develop the electrostatic latent images by developing portions to form toner images of different colors; an intermediary transfer member configured to be rotatable; a primary transfer portion for transferring the toner images formed on the image carrying members to the intermediary transfer member; and a secondary transfer roller for secondarily transferring the toner images transferred to the intermediary transfer member to a transfer-destination material, the secondary transfer roller being configured to be rotatable and releasably contactable with the intermediary transfer member. Here, the plurality of image forming units are operable to form registration patches for detection of displacements of the toner images such that, with the secondary transfer roller released from the intermediary transfer member, the registration patches are primarily transferred to the intermediary transfer member so that the registration patches on the intermediary transfer member are detected by a detecting portion and, based on the results of the detection, the displacement amounts of the registration patches of the different colors in the sub scanning direction are calculated to correct the positions at which the exposing portions write the electrostatic latent images. Moreover, the image forming apparatus is provided with: a storing portion for storing, as a reference rotation speed, the rotation speed of the intermediary transfer member as observed when the intermediary transfer member is brand-new; and a correcting portion for correcting, based on the rotation speed difference between the rotation speed of the intermediary transfer member as observed when the registration patches are formed and the reference rotation speed, the calculated displacement amounts into displacement amounts expected when the secondary transfer roller is contacted with the intermediary transfer member. Here, the positions at which the exposing portions write the electrostatic latent images are corrected based on the corrected displacement amounts.

According to another aspect of the present invention, an image forming apparatus includes: a plurality of image forming units configured to write electrostatic latent images on image carrying members by exposing portions and develop the electrostatic latent images by developing portions to form toner images of different colors; an intermediary transfer member configured to be rotatable; a primary transfer portion for transferring the toner images formed on the image carrying members to the intermediary transfer member; and a secondary transfer roller for secondarily transferring the toner images transferred to the intermediary transfer member to a transfer-destination material, the secondary transfer roller being configured to be rotatable and releasably contactable with the intermediary transfer member. Here, the plurality of image forming units are operable to form registration patches for detection of displacements of the toner images such that, with the secondary transfer roller released from the intermediary transfer member, the registration patches are primarily transferred to the intermediary transfer member so that the registration patches on the intermediary transfer member are detected by a detecting portion and, based on the results of the detection, the displacement amounts of the registration patches of the different colors in the sub scanning direction are calculated to correct the positions at which the exposing portions write the electrostatic latent images. Moreover, the image forming apparatus is provided with: a storing portion for storing, as a reference time, the time that elapses after the exposing portions start to write the registration patches on the image carrying members until the detecting portion detects the registration patches on the intermediary transfer member when the intermediary transfer member is brand-new; and a correcting portion for correcting, based on the time difference between the time that elapses after the exposing portions start to write the registration patches on the image carrying members until the detecting portion detects the registration patches on the intermediary transfer member during a displacement detection procedure and the reference time, the calculated displacement amounts into displacement amounts expected when the secondary transfer roller is contacted with the intermediary transfer member. Here, the positions at which the exposing portions write the electrostatic latent images are corrected based on the corrected displacement amounts.

DETAILED DESCRIPTION OF THE INVENTION

Hereinafter, an image forming apparatus according to the present invention will be described with reference to the accompanying drawings. The present invention, however, is not limited by any embodiment mentioned herein.

Preferred Embodiment

Figure 1:
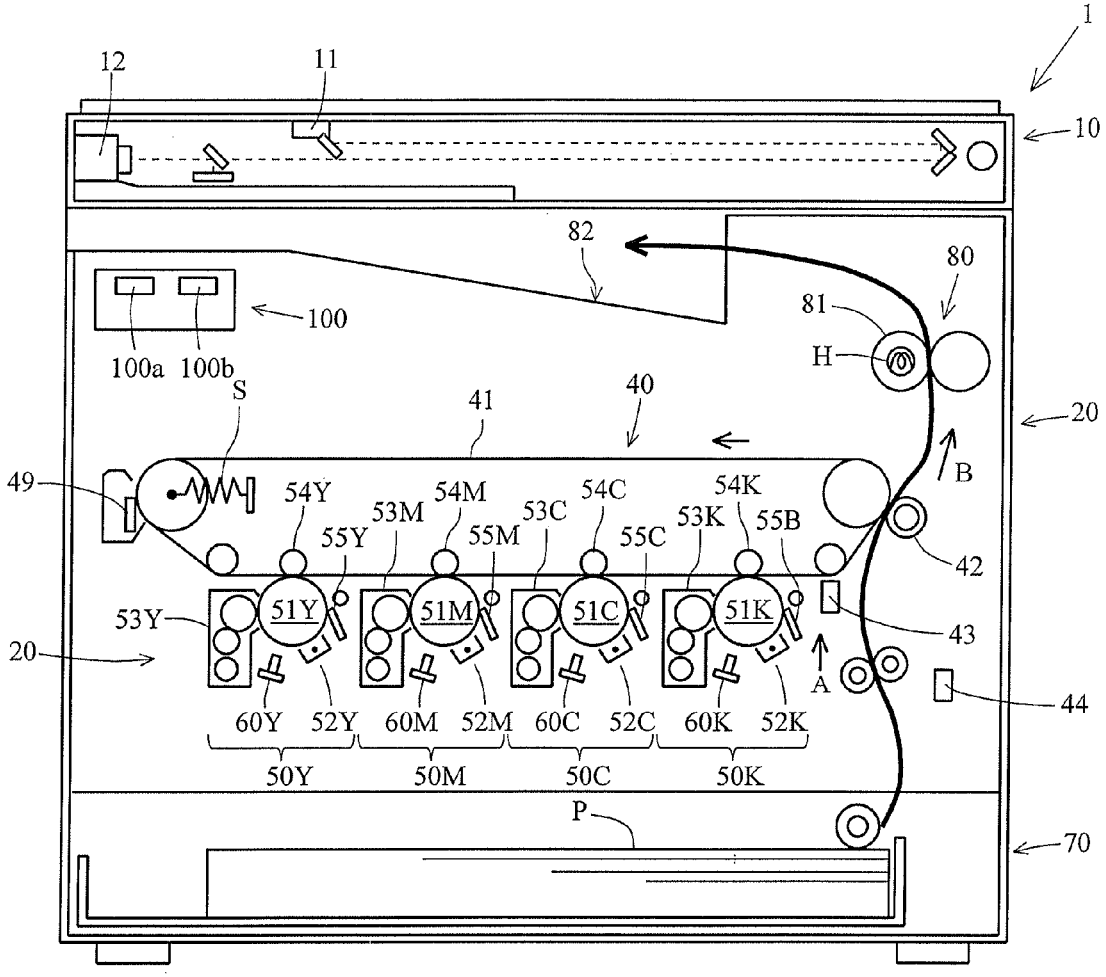
FIG. 1 is an outline diagram showing an example of an image forming apparatus (copier) according to the present invention.

FIG. 1 is an outline diagram of a tandem-type full-color copier (hereinafter also referred to simply as "copier") as one example of an image forming apparatus according to the present invention. The copier will be described below with reference to the drawings.

(Overall Structure of the Copier)

The copier in FIG. 1 is provided with an image reading section 10, an image forming section 20, and a control section 100.

The image reading section 10 is configured to read an image of a document placed on an unillustrated document placement glass plate while moving a scanner 11 across it. The document image obtained through irradiation by an exposure lamp provided in the scanner 11 is imaged by an optical system, and is then converted, through analog-to-digital conversion by CCD image sensors 12 corresponding to light of three wavelengths, namely red (R), green (G), and blue (B) respectively, into R, G, and B image data corresponding to the document.

The obtained image data of the different color components is then, in the control section 100, subjected to various kinds of data processing, and is thereby converted further into image data of reproduction colors, namely Y (yellow), M (magenta), C (cyan), and K (black) (hereinafter, the reference signs for components corresponding to the different reproduction colors are suffixed with Y, M, C, and K respectively). The converted image data is stored, separately for each reproduction color, in an image memory 100*a* within the control section 100, and is read out for one scanning line after another in synchronism with the feeding of a sheet P of a printing medium to produce driving signals for laser diodes (unillustrated, hereinafter referred to as "LDs") for exposing photoconductive drums (image carrying members) 51Y to 51K.

The image forming section 20 is configured to form an image by the well-known electrophotography process. The image forming section 20 is composed of an intermediary transfer section 40 having an intermediary transfer belt (intermediary transfer member) 41 laid across it and image forming units 50Y to 50K, for the different colors Y, M, C, and K respectively, arranged opposite the intermediary transfer belt 41 at predetermined intervals along the intermediary transfer belt 41 from the upstream side with respect to its circulation direction (hereinafter referred to simply as "upstream side") to the downstream side with respect to its circulation direction (hereinafter referred to simply as "downstream side").

Further provided on the transport path for the sheet P which runs in the direction indicated by arrow B are a sheet feed section 70 for feeding the sheet P to a secondary transfer position in the intermediary transfer section 40, and a fusing section 80 arranged on the downstream side of the secondary transfer position in the intermediary transfer section 40 with respect to the sheet transport direction.

The image forming units 50Y to 50K for the different colors Y, M, C, and K respectively include exposing devices 60Y to 60K, which are respectively provided with LDs (unillustrated) that are fed with the drive signals from the control section 100 to emit laser light, polygon mirrors (unillustrated) for deflecting the laser light to scan it across the photoconductive drums 51Y to 51K in the main scanning direction for exposure, etc. The image forming units 50Y to 50K further include, respectively, the photoconductive drums 51Y to 51K, electrostatic chargers 52Y to 52K arranged around them, developing devices 53Y to 53K, primary transfer rollers 54Y to 54K, cleaners 55Y to 55K, etc.

Before exposure, the photoconductive drums 51Y to 51K have the toner remaining on their surface removed by the cleaners 55Y to 55K, are then irradiated by an unillustrated eraser lamp to be electrostatically discharged, and are then electrostatically charged uniformly by the electrostatic chargers 52Y to 52K. When the photoconductive drums 51Y to 51K in the thus electrostatically charged state are exposed to the laser light, electrostatic latent images are formed on their surface.

The developing devices 53Y to 53K respectively accommodate two-component developer containing toner of the different colors at predetermined toner concentrations. The electrostatic latent images are developed with the toner of the corresponding colors by the developing devices 53Y to 53K for the different colors. Thus, on the surface of the photoconductive drums 51Y to 51K, toner images of Y, M, C, and K are formed respectively. The toner images are then, at their respective transfer positions, by the action of the primary transfer rollers 54Y to 54K arranged on the opposite side of the intermediary transfer belt 41, transferred sequentially to the intermediary transfer belt 41 which circulates in the direction indicated by an arrow. Here, the image forming operation is performed with time lags among the different colors so that the tonner images are transferred in the same position on the circulating intermediary transfer belt 41.

The intermediary transfer belt 41 having the toner images of the different colors multiply transferred to it further circulates to a position where the intermediary transfer belt 41 makes contact with a secondary transfer roller 42 arranged opposite it to form a transfer nip portion. To the transfer nip portion is also transported the sheet P in synchronism with the circulation of the intermediary transfer belt 41. Thus, at the transfer nip portion, the toner images of the different colors multiply transferred to the intermediary transfer belt 41 are transferred to the sheet P. The toner left untransferred to the sheet P and remaining on the intermediary transfer belt 41 is removed and collected by a cleaning blade 49.

The sheet P having the toner images of the different colors multiply transferred to it is transported in the direction indicated by arrow B to the fusing section 80. The fusing section 80 includes a fusing roller 81 which is provided with a heater H inside, and the control section 100 controls the energization of the heater H. The sheet P is pressed under high temperature by the fusing roller 81 so that the toner particles on the surface of the fusing roller 81 are melted and fused onto the surface of the sheet. The sheet P is then discharged onto a sheet discharge tray 82.

The control section 100 thus controls ordinary image forming operation as described above; in addition, it also controls the timing and content of control for optimization of image forming conditions. Specifically, control for optimizing image forming conditions is performed to achieve proper image formation all the time by coping with fluctuations in image quality due to environmental, secular, and other changes. One method of control for optimizing image forming conditions is registration correction. The content of control for registration correction will now be described.

Figure 2:
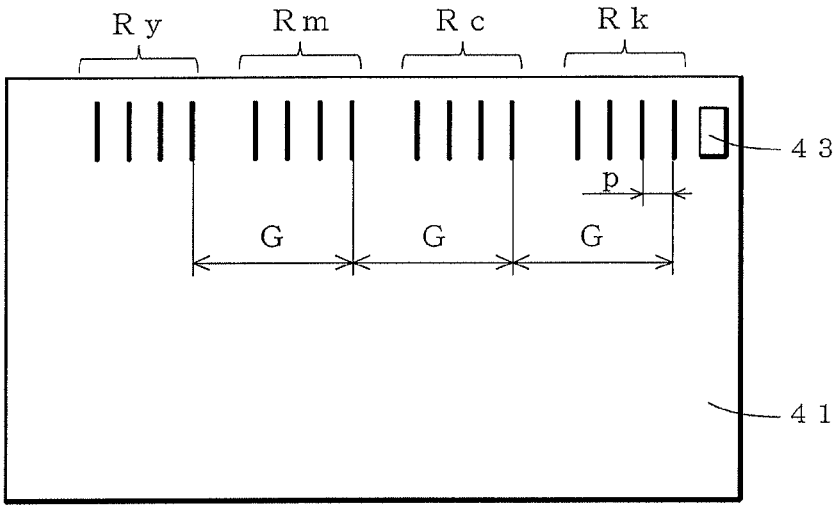
FIG. 2 is a diagram showing an example of registration patches formed on an intermediary transfer belt.

FIG. 2 shows an example of registration patches that are formed on the intermediary transfer belt 41 during displacement detection. FIG. 2 is a view of the intermediary transfer belt 41 as seen from the direction indicated by arrow A in FIG. 1. As shown in FIG. 2, the registration patches Rk to Ry comprise, for each color, a plurality of straight lines perpendicular to the belt running direction (that is, parallel to the main scanning direction). Print data for forming the registration patches Rk to Ry is previously stored in a storing portion 100*b*, and based on the print data, the image forming units 50Y to 50K form the registration patches Rk to Ry on the intermediary transfer belt 41. When there is no color displacement, the registration patches Rk to Ry are formed in such a way that, when the plurality of straight lines for each color are serially numbered from the foremost to the last one among them, the straight lines with the same number (those in the same serial position) are formed at a distance G from one another in the direction parallel to the belt running direction (that is, in the sub scanning direction).

In FIG. 2, the pitch p at which the registration patches Rk to Ry are formed is equal to one-fourth of the circumferential length of the photoconductive drums. The pitch p of the registration patches Rk to Ry is subject to no particular restriction; preferably, however, it is equal to the circumferential length, or an equal division of the circumferential length, of the photoconductive drums. This helps eliminate the influence of a runout in the rotation axes of the photoconductive drums.

The registration patches Rk to Ry primarily transferred from the photoconductive drums 51Y to 51K to the intermediary transfer belt 41 are, as the intermediary transfer belt 41 moves, detected sequentially by a displacement sensor 43, and the resulting detection signal is fed to the control section 100. Based on the detection signal from the displacement sensor 43, the control section 100, taking the position of the registration patch Rk for color K as a reference, measures the time that elapses after the registration patch Rk is detected until each of the registration patches Rc to Ry for the other colors is detected. Then, based on the differences of the actually measured times from the times expected when there is no color displacement, the control section 100 calculates displacement amounts Hy, Hm, and Hc in the sub scanning direction. Here, for each color, the displacement amounts measured between the straight lines in the same serial positions are averaged. The calculation of the displacement amounts Hy, Hm, and Hc themselves can be done by a well-known method.

Figure 3A:
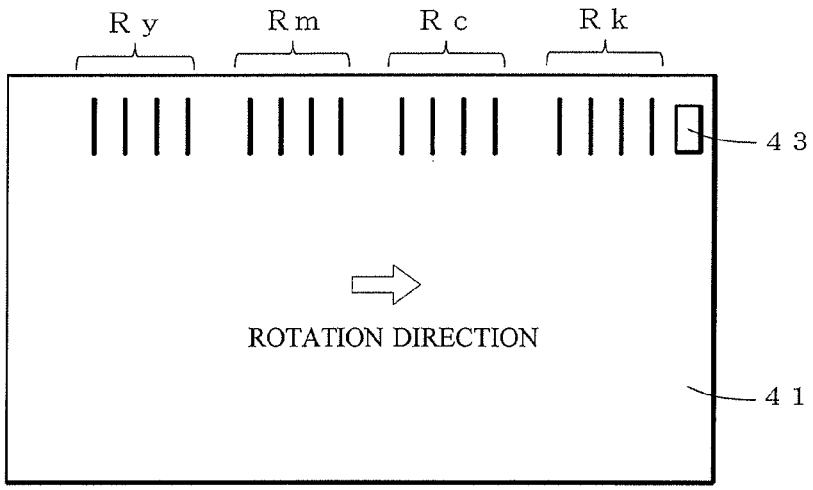
FIGS. 3A and 3B are diagrams respectively showing registration patches with a secondary transfer roller press-contacted with, and released from, an intermediary transfer belt.
Figure 3B:
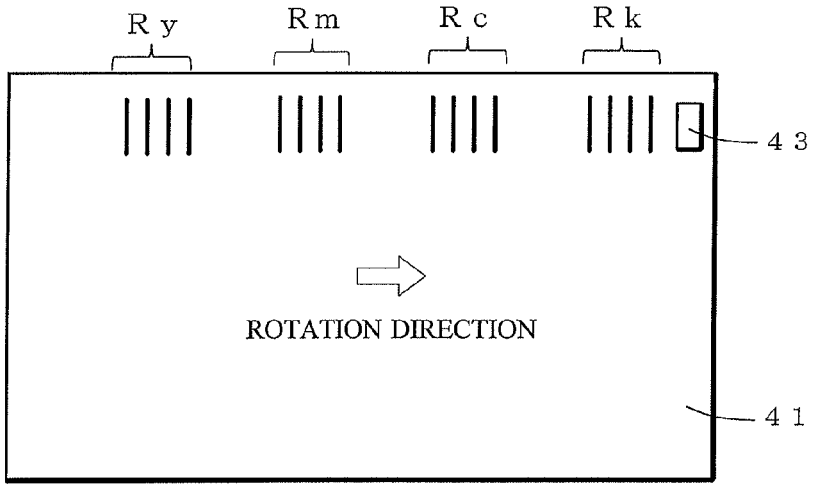

As shown in FIGS. 3A and 3B, however, as the intermediary transfer belt deteriorates with time, the rotation speed of the intermediary transfer belt becomes lower when the secondary transfer roller is released from it than when the secondary transfer roller is contacted with it, and accordingly the times that elapse after the registration patch Rk for color K is detected until the registration patches Rc to Ry for the other colors are detected become longer when the secondary transfer roller is released than when the secondary transfer roller is press-contacted. As a result, actual image formation and registration correction are performed under different conditions, and this makes accurate correction of a color displacement impossible.

The inventors of the present invention have found that a brand-new intermediary transfer belt 41 rotates at the same speed regardless of whether the secondary transfer roller 42 is contacted with or released from the intermediary transfer belt 41, and that even an intermediary transfer belt 41 that has deteriorated with time through use rotates, so long as the secondary transfer roller 42 is contacted with it, at substantially the same speed as when the intermediary transfer belt 41 was brand-new. These findings have led the inventors to the following solution: the rotation speed of the intermediary transfer belt 41 as observed when it is brand-new is taken as its rotation speed (the reference rotation speed) during continuous use as expected with the secondary transfer roller 42 contacted with the intermediary transfer belt 41, and is stored in the storing portion 100*b*; based on the reference rotation speed, the difference in the rotation speed of the intermediary transfer belt 41 depending on whether the secondary transfer roller 42 is contacted with or released from the intermediary transfer belt 41 is calculated; and based on the calculated difference in rotation speed, displacement amounts are corrected.

In the present invention, first, while the intermediary transfer belt 41 is brand-new, with the secondary transfer roller 42 released from it, the registration patches Rk to Ry shown in FIG. 2 are formed, and with the displacement sensor 43, for example, the time that elapses after the exposing device 60K starts to write the registration patch Rk until the displacement sensor 43 detects the registration patch Rk is measured with reference to an internal timer. Then, based on data previously fed in—the distance from the position on the photoconductive drum 51K exposed by the exposing device 60K to the primary transfer position, the distance from the primary transfer position to the displacement sensor 43, and the rotation speed of the photoconductive drum 51K, the rotation speed of the intermediary transfer belt 41 is calculated, and is stored, as a reference rotation speed Vb, in the storing portion 100*b*.

Figure 4:
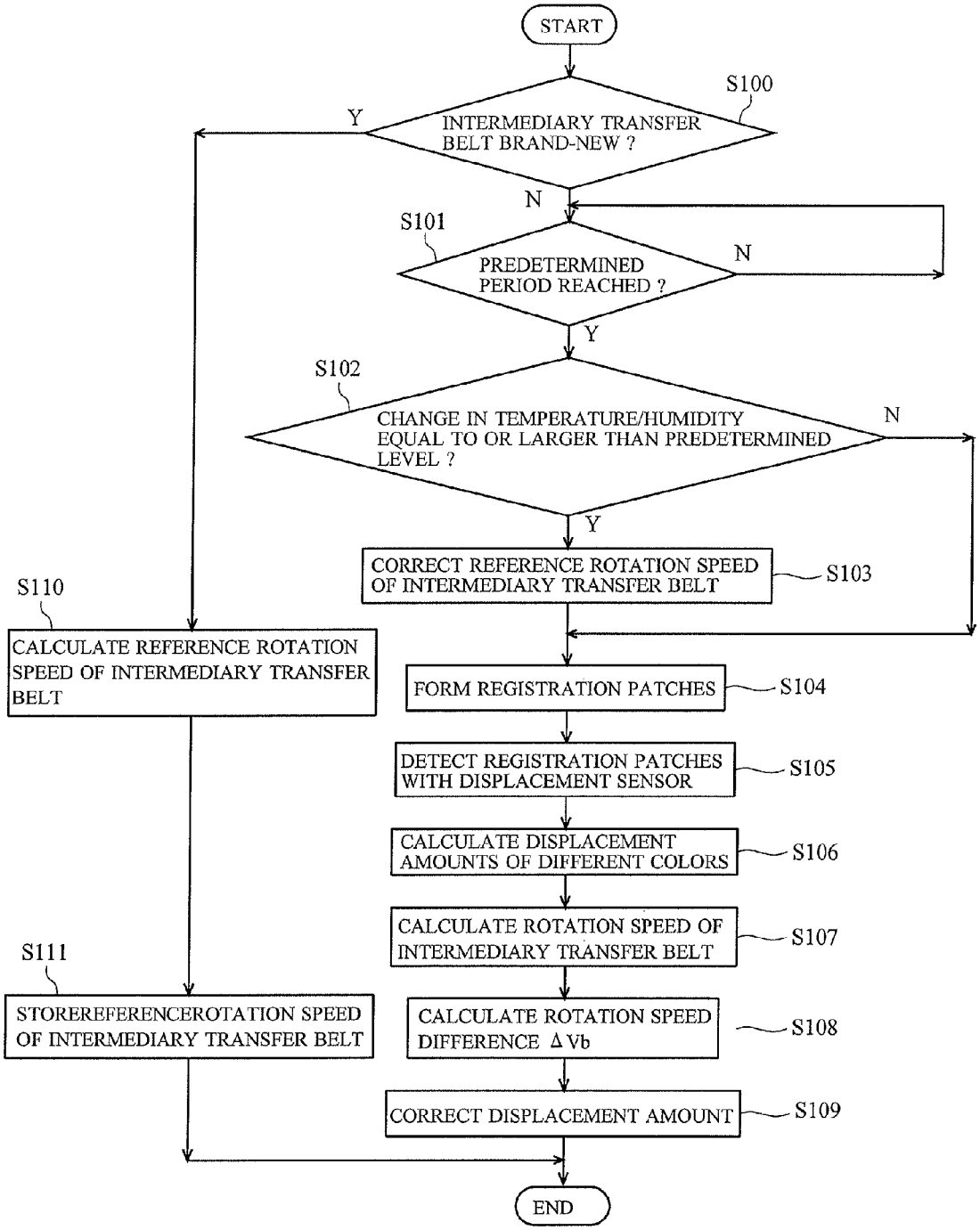
FIG. 4 is an example of a flow chart for correction of displacement amounts.

Then, through a displacement detection procedure, based on the difference ΔVb between the reference rotation speed Vb of the intermediary transfer belt 41 and its actual rotation speed Vb', the detected displacement amounts are corrected. FIG. 4 is an example of a flow chart showing the content of the displacement detection procedure.

In the displacement detection procedure, first, whether or not the intermediary transfer belt 41 is brand-new is checked (step S100). If the intermediary transfer belt 41 is brand-new, the reference rotation speed Vb of the intermediary transfer belt 41 is calculated (step S110), and is stored in the storing portion 100*b* (step S111).

If the intermediary transfer belt 41 is not brand-new (step S100), whether or not a displacement detection period has reached (step S101) is checked. Displacement detection periods are, for example, when the power to the apparatus is turned on, and when a predetermined number of sheets have been printed. Incidentally, the procedure is started with the secondary transfer roller 42 located in the released position. If the secondary transfer roller 42 happens to be located in the press-contacted position, when starting the procedure, the control section 100 controls an actuator to move the secondary transfer roller 42 to the released position.

Next, whether or not a change in temperature detected by a temperature sensor 44 is equal to or larger than a predetermined level is checked (step S102). This is done because the outer diameter of the secondary transfer roller 42, which is formed of rubber foam or the like, varies with temperature, and this produces a slight change in the rotation speed of the intermediary transfer belt 41 when the secondary transfer roller 42 is press-contacted with it, possibly resulting in a color displacement. If the change in temperature is equal to or larger than the predetermined level, the reference rotation speed of the intermediary transfer belt 41 is corrected to prevent a color displacement (step S103). Incidentally, a relationship between the amount of change in temperature and the amount of correction to be made to the rotation speed is previously determined through experiments or the like, and is stored in the storing portion 100*b*.

Next, the registration patches Rk to Ry are formed on the intermediary transfer belt 41 (step S104), and the formed registration patches Rk to Ry are detected by the displacement sensor 43 (step S105).

Then, based on the results of the detection of the registration patches Rk to Ry, the displacement amounts of the different colors are calculated respectively (step S106). At the same time, with respect to the registration patch Rk, the time that elapses after the exposing device 60K starts to write the registration patch Rk until the displacement sensor 43 detects the registration patch Rk is measured with reference to the internal timer, and the rotation speed Vb' of the intermediary transfer belt 41 is calculated (step S107).

Then, based on the calculated rotation speed Vb' of the intermediary transfer belt 41 and the reference rotation speed Vb stored in the storing portion 100*b*, the rotation speed difference ΔVb (=Vb−Vb') of the intermediary transfer belt is determined (step S108).

Next, the displacement amounts Hy, Hm, and Hc are corrected according to the rotation speed difference ΔVb (step S109). Specifically, for example for color Y, the current displacement amount Hy is replaced with a value obtained by subtracting from it the displacement ΔHy of the write timing for color Y from that for color K due to the rotation speed difference ΔVb. Such displacements ΔHy, ΔHm, and ΔHc are given by the following equations respectively:

$$\Delta Hy = Py/\Delta Vb$$

$$\Delta Hm = Pm/\Delta Vb$$

$$\Delta Hc = Pc/\Delta Vb$$

In the equations, Py, Pm, and Pc represent the intervals (pitches) at which the photoconductive drums are arranged with respect to color K.

Thus, once the procedure is completed, during actual image formation, the timing of image writing is controlled according to the displacement amounts Hm to Hc that have been corrected for the displacements due to a difference in the speed of the intermediary transfer belt 41. In this way, it is possible to prevent color displacements due to variations in the speed of the intermediary transfer belt 41 resulting from secular deterioration of the intermediary transfer belt 41 or from abrupt changes in temperature.

Incidentally, the time it takes for the registration patches written by the exposing devices to be transported to the primary transfer portion by the rotation of the photoconductive drums is fixed. Accordingly, instead of the rotation speed of the intermediary transfer belt, the time that elapses after the exposing portions start to write the registration patches on the photoconductive drums until the registration patches on the intermediary transfer belt are detected by the displacement sensor 43 may be used to correct displacement amounts. That is, the time that elapses, when the intermediary transfer belt is brand-new, after the exposing portions start to write the registration patches on the photoconductive drums until the registration patches on the intermediary transfer belt are detected by the displacement sensor 43 is stored, as the reference time, in the storing portion 100*b*. Thereafter, in the displacement detection procedure, the time that elapses after the exposing devices start to write the registration patches on the photoconductive drums until the registration patches on the intermediary transfer belt are detected by the displacement sensor 43 is measured. Then, based on the difference between the measured time and the reference time, the displacement amounts calculated as described previously are corrected into displacement amounts expected when the secondary transfer roller is contacted with the intermediary transfer member.

What is claimed is:

1. An image forming apparatus including:

a plurality of image forming units configured to write electrostatic latent images on image carrying members by exposing portions and develop the electrostatic latent images by developing portions to form toner images of different colors;

an intermediary transfer member configured to be rotatable;

a primary transfer portion for transferring the toner images formed on the image carrying members to the intermediary transfer member; and a secondary transfer roller for secondarily transferring the toner images transferred to the intermediary transfer member to a transfer-destination material, the secondary transfer roller being configured to be rotatable and releasably contactable with the intermediary transfer member, the plurality of image forming units being operable to form registration patches for detection of displacements of the toner images such that, with the secondary transfer roller released from the intermediary transfer member, the registration patches are primarily transferred to the intermediary transfer member so that the registration patches on the intermediary transfer member are detected by a detecting portion and, based on results detected by the the detecting portion, calculated displacement amounts of the registration patches of the different colors in a sub scanning direction are calculated to correct positions at which the exposing portions write the electrostatic latent images, a storing portion that stores a reference rotation speed of the intermediary transfer member determined at an initial use of the intermediary transfer member, as observed when the intermediary transfer member is brand-new; and a correcting portion including a processor that performs a displacement correction procedure including the steps of:

forming the registration patches on the intermediary member at the time the displacement correction procedure is performed;

determining a rotation speed of the intermediary member with the secondary roller released from the intermediary transfer member using the registration patches formed at the time the displacement correction procedure is performed;

correcting, based on a rotation speed difference between the rotation speed of the intermediary transfer member and the reference rotation speed stored in the storing portion, the calculated displacement amounts to form corrected displacement amounts expected when the secondary transfer roller is contacted with the intermediary transfer member, and correcting the positions at which the exposing portions write the electrostatic latent images based on the corrected displacement amounts, wherein the displacement correction procedure is performed at least twice, whereby the reference rotation speed determined once at the initial use of the intermediary transfer member is used at least twice.

2. The image forming apparatus according to claim 1, further comprising a temperature detecting portion for detecting a temperature inside the image forming apparatus, wherein the reference rotation speed of the intermediary transfer member is corrected based on the temperature inside the image forming apparatus detected by the temperature detecting portion.

3. The image forming apparatus according to claim 1, wherein the registration patches comprise a plurality of straight lines perpendicular to a rotation direction of the intermediary transfer member and formed at predetermined intervals in the rotation direction, and the interval of the straight lines is equal to a circumferential length, or an equal division of a circumferential length, of the image carrying members.

4. An image forming apparatus including:

a plurality of image forming units configured to write electrostatic latent images on image carrying members by exposing portions and develop the electrostatic latent images by developing portions to form toner images of different colors;

an intermediary transfer member configured to be rotatable;

a primary transfer portion for transferring the toner images formed on the image carrying members to the intermediary transfer member; and a secondary transfer roller for secondarily transferring the toner images transferred to the intermediary transfer member to a transfer-destination material, the secondary transfer roller being configured to be rotatable and releasably contactable with the intermediary transfer member, the plurality of image forming units being operable to form registration patches for detection of displacements of the toner images such that, with the secondary transfer roller released from the intermediary transfer member, the registration patches are primarily transferred to the intermediary transfer member so that the registration patches on the intermediary transfer member are detected by a detecting portion and, based on results detected by the detecting portion, calculated displacement amounts of the registration patches of the different colors in a sub scanning direction are calculated to correct positions at which the exposing portions write the electrostatic latent images, a storing portion that stores a reference time that elapses after the exposing portions start to write the registration patches on the image carrying members until the detecting portion detects the registration patches on the intermediary transfer member determined at an initial use of the intermediary transfer member when the intermediary transfer member is brand-new; and a correcting portion including a processor that performs a displacement correction procedure including the steps of:

forming the registration patches on the intermediary member at the time the displacement correction procedure is performed;

determining a time that elapses after the exposing portions start to write the registration patches on the image carrying members until the detecting portions detects the registration patches on the intermediary transfer member at the time the displacement correction procedure is performed, correcting, based on a time difference between the time that elapses after the exposing portions start to write the registration patches on the image carrying members until the detecting portion detects the registration patches on the intermediary transfer member at the time of the displacement detection procedure and the reference time stored in the storing portion, the calculated displacement amounts to form corrected displacement amounts expected when the secondary transfer roller is contacted with the intermediary transfer member, and correcting the positions at which the exposing portions write the electrostatic latent images based on the corrected displacement amounts, wherein the displacement correction procedure is performed at least twice, whereby the reference time determined once at the initial use of the intermediary transfer member is used at least twice.

5. The image forming apparatus according to claim 4, further comprising a temperature detecting portion for detecting a temperature inside the image forming apparatus, wherein the reference time is corrected based on the temperature inside the image forming apparatus detected by the temperature detecting portion.

6. The image forming apparatus according to claim 4, wherein the registration patches comprise a plurality of straight lines perpendicular to a rotation direction of the intermediary transfer member and formed at predetermined intervals in the rotation direction, and the interval of the straight lines is equal to a circumferential length, or an equal division of a circumferential length, of the image carrying members.

7. The image forming apparatus according to claim 1, wherein each time the registration patches are formed the secondary transfer roller is not in contact with the intermediary transfer member.

8. The image forming apparatus according to claim 4, wherein each time the registration patches are formed the secondary transfer roller is not in contact with the intermediary transfer member.

9. The image forming apparatus according to claim 1, wherein the registration patches are transferred to the intermediary transfer member with the secondary transfer roller released from the intermediary transfer member, at an initial use of the intermediary transfer member as observed when the intermediary transfer member is brand-new, and the detecting portion detects the registration patches on the intermediary transfer member, the image forming apparatus further comprising a determining portion including a processor that determines the reference rotation speed based on the detected result of the registration patches on the intermediary transfer member.

10. The image forming apparatus according to claim 4, wherein the registration patches are transferred to the intermediary transfer member with the secondary transfer roller released from the intermediary transfer member, at an initial use of the intermediary transfer member as observed when the intermediary transfer member is brand-new, and the detecting portion detects the registration patches on the intermediary transfer member, the image forming apparatus further comprising a determining portion including a processor that determines the reference time based on the detected result of the registration patches on the intermediary transfer member.

11. A non-transitory computer-readable medium for performing a displacement correction in an image forming apparatus having a plurality of image forming units configured to write electrostatic latent images on image carrying members by exposing portions and develop the electrostatic latent images by developing portions to form toner images of different colors; an intermediary transfer member configured to be rotatable; a primary transfer portion for transferring the toner images formed on the image carrying members to the intermediary transfer member; a secondary transfer roller for secondarily transferring the toner images transferred to the intermediary transfer member to a transfer-destination material, the secondary transfer roller being configured to be rotatable and releasably contactable with the intermediary transfer member, a detecting portion, and a storing portion that stores a reference rotation speed of the intermediary transfer member determined at an initial use of the intermediary transfer member, as observed when the intermediary transfer member is brand-new, the non-transitory computer-readable medium including instructions stored thereon, that when executed on a processor, perform a displacement correction procedure including the steps of:

causing the plurality of image forming units to form registration patches on the intermediary member;

determining a rotation speed of the intermediary member with the secondary roller released from the intermediary transfer member using the registration patches;

correcting, based on a rotation speed difference between the rotation speed of the intermediary transfer member and the reference rotation speed stored in the storing portion, calculated displacement amounts to form corrected displacement amounts expected when the secondary transfer roller is contacted with the intermediary transfer member, and correcting the positions at which exposing portions of the image forming units write electrostatic latent images based on the corrected displacement amounts, wherein the displacement correction procedure is performed at least twice, whereby the reference rotation speed determined once at the initial use of the intermediary transfer member is used at least twice.

12. The non-transitory computer-readable medium according to claim 11, wherein the image forming apparatus further includes a temperature detecting portion for detecting a temperature inside the image forming apparatus, and the non-transitory computer-readable medium further includes instructions stored thereon that, when executed on a processor, performs the steps of correcting the reference rotation speed of the intermediary transfer member based on the temperature inside the image forming apparatus detected by the temperature detecting portion.

13. The non-transitory computer-readable medium according to claim 11, wherein the registration patches comprise a plurality of straight lines perpendicular to a rotation direction of the intermediary transfer member and formed at predetermined intervals in the rotation direction, and the interval of the straight lines is equal to a circumferential length, or an equal division of a circumferential length, of the image carrying members.

14. A non-transitory computer-readable medium for performing a displacement correction in an image forming apparatus including a plurality of image forming units configured to write electrostatic latent images on image carrying members by exposing portions and develop the electrostatic latent images by developing portions to form toner images of different colors; an intermediary transfer member configured to be rotatable; a primary transfer portion for transferring the toner images formed on the image carrying members to the intermediary transfer member; a secondary transfer roller for secondarily transferring the toner images transferred to the intermediary transfer member to a transfer-destination material, the secondary transfer roller being configured to be rotatable and releasably contactable with the intermediary transfer member; a detecting portion; and a storing portion that stores a reference time that elapses after the exposing portions start to write the registration patches on the image carrying members until the detecting portion detects the registration patches on the intermediary transfer member determined at an initial use of the intermediary transfer member when the intermediary transfer member is brand-new, the non-transitory computer-readable medium including instructions stored thereon, that when executed on a processor, perform a displacement correction procedure including the steps of:

causing the plurality of image forming units to form registration patches on the intermediary member;

determining a time that elapses after the exposing portions start to write the registration patches on the image carrying members until the detecting portions detects the registration patches on the intermediary transfer member, correcting, based on a time difference between the time that elapses after the exposing portions start to write the registration patches on the image carrying members until the detecting portion detects the registration patches on the intermediary transfer member and the reference time stored in the storing portion, calculated displacement amounts to form corrected displacement amounts expected when the secondary transfer roller is contacted with the intermediary transfer member, and correcting the positions at which the exposing portions write the electrostatic latent images based on the corrected displacement amounts, wherein the displacement correction procedure is performed at least twice, whereby the reference time determined once at the initial use of the intermediary transfer member is used at least twice.

15. The non-transitory computer-readable medium according to claim 14, wherein the image forming apparatus further includes a temperature detecting portion for detecting a temperature inside the image forming apparatus, and the non-transitory computer-readable medium further includes instructions stored thereon that, when executed on a processor, performs the steps of correcting the reference time of the intermediary transfer member based on the temperature inside the image forming apparatus detected by the temperature detecting portion.

16. The non-transitory computer-readable medium according to claim 14, wherein the registration patches comprise a plurality of straight lines perpendicular to a rotation direction of the intermediary transfer member and formed at predetermined intervals in the rotation direction, and the interval of the straight lines is equal to a circumferential length, or an equal division of a circumferential length, of the image carrying members.

17. The non-transitory computer-readable medium according to claim 11, wherein each time the registration patches are formed the secondary transfer roller is not in contact with the intermediary transfer member.

18. The non-transitory computer-readable medium according to claim 14, wherein each time the registration patches are formed the secondary transfer roller is not in contact with the intermediary transfer member.

19. The non-transitory computer-readable medium according to claim 11, further including instructions stored thereon, that when executed on a processor, perform the steps of:

causing the registration patches to be transferred to the intermediary transfer member with the secondary transfer roller released from the intermediary transfer member, at an initial use of the intermediary transfer member as observed when the intermediary transfer member is brand-new, causing the detecting portion to detect the registration patches on the intermediary transfer member, determining the reference rotation speed based on the detected result of the registration patches on the intermediary transfer member.

20. The non-transitory computer-readable medium according to claim 14, further including instructions stored thereon, that when executed on a processor, perform the steps of:

causing the registration patches to be transferred to the intermediary transfer member with the secondary transfer roller released from the intermediary transfer member, at an initial use of the intermediary transfer member as observed when the intermediary transfer member is brand-new, causing the detecting portion to detect the registration patches on the intermediary transfer member, determining the reference time based on the detected result of the registration patches on the intermediary transfer member.

* * * * *